US007071892B2

(12) United States Patent
Astrin

(10) Patent No.: US 7,071,892 B2
(45) Date of Patent: Jul. 4, 2006

(54) KEYED ANTENNA ADAPTER

(75) Inventor: Arthur W. Astrin, Palo Alto, CA (US)

(73) Assignee: Apple Computer, Inc., Cupertino, CA (US)

( * ) Notice: Subject to any disclaimer, the term of this patent is extended or adjusted under 35 U.S.C. 154(b) by 191 days.

(21) Appl. No.: 10/397,055

(22) Filed: Mar. 25, 2003

(65) Prior Publication Data

US 2004/0189544 A1 Sep. 30, 2004

(51) Int. Cl.
*H01Q 1/50* (2006.01)
*H06F 7/00* (2006.01)

(52) U.S. Cl. ..... 343/850; 340/825.72; 343/718

(58) Field of Classification Search ..... 343/906, 343/711–713, 850, 718, 700 MS; 307/10.5, 307/10.1–10.3; 340/5.62, 5.64, 5.72, 825.31, 340/825.72, 825.69, 10.1
See application file for complete search history.

(56) References Cited

U.S. PATENT DOCUMENTS 5,542,274 A * 8/1996 Thordmark et al. ..... 70/495
5,742,236 A * 4/1998 Cremers et al. ..... 340/5.26
5,763,958 A * 6/1998 Yamamoto et al. ..... 307/10.5
6,131,136 A * 10/2000 Liebenow et al. ..... 710/316
6,400,255 B1 * 6/2002 Ohnishi et al. ..... 340/5.62
6,683,391 B1 * 1/2004 Enoyoshi et al. ..... 307/10.5
6,700,220 B1 * 3/2004 Bayeur et al. ..... 307/10.2
6,748,536 B1 * 6/2004 Madau ..... 713/193
2003/0084691 A1 * 5/2003 Kato et al. ..... 70/278.3

* cited by examiner

*Primary Examiner*—Thuy V. Tran
*Assistant Examiner*—Chuc Tran
(74) *Attorney, Agent, or Firm*—Henneman & Saunders; Larry E. Henneman, Jr.

(57) ABSTRACT

A keyed antenna apparatus (10, 10, 10*b*) for adapting a wireless access point (12, 12*a*, 12*b*) to an external antenna (52, 54) or an external antenna group (22). A plurality of notches (62, 64) in a keyed jack (26, 26*a*, 26*b*, 26*c*) accept a keyed plug (28, 28*a*, 28*b*) having thereon key projections (72, 74). The key projections (72, 74) produce signals by depressing microswitches (76), contacting electrical contacts (78), or the like. The signals selectively cause an antenna switch (18) to switch a signal path (19) between internal antennas (50, 20*a*, 20*b*) and external antennas (52, 54). Further, the signals selectively cause a wireless adapter (16) to modify radio frequency signal characteristics, such as power.

27 Claims, 4 Drawing Sheets

KEYED ANTENNA ADAPTER

TECHNICAL FIELD

The present invention relates generally to the field of electromechanical devices, and more particularly to a keyed socket and matching plug for an antenna used for wireless data communications, which socket provides a signal for adapting the transmitter to the particular antenna installed therein. The predominant current application for the inventive keyed antenna adapter is in the field of wireless networking, where practical and legal considerations dictate that adjustment to signal properties be made based upon the particular antenna currently in use.

BACKGROUND ART

As the proliferation of computers increases, it has become increasingly important to communicate with other nearby computers through local area networks ("LAN") and the like. It has been found that the usefulness of such arrangements is enhanced by using wireless connections, rather than just hard wired connections. This both allows for the transportability of individual units, and makes easier the connection between even those units that are not intended to be portable. At one point in the art, infra red ("IR") frequency communication was considered to be the state of the art for communicating between computers and computer peripherals in close proximity to each other, and IR communication is still quite useful when such devices are, indeed, in very close proximity. However, IR has several well known limitations, including the fact that devices must be very close together to communicate, and they must be in a line of sight arrangement. Further, the bandwidth of IR is quite limited, and IR is quite susceptible to interference from radiant heat sources, and the like.

Because of the limitations of IR, radio frequency devices have recently become popular for the interconnection of computers and computer peripheral devices. Some such radio frequency devices have used proprietary signaling schemes. However, it has even more recently become popular to use industry standard frequencies and data transfer protocols, such that devices from different manufacturers can be made to communicate together. Unfortunately, the great proliferation of such devices, using the same frequencies, has led to a situation where there is a potential problem with interference between nearby devices that are not intended to communicate with each other. Further, such radio frequency devices can, potentially, cause interference with many other nearby devices, such as radios, televisions, and the like.

There are opposing interests at work, then. A user might want to maximize the transmission power and/or other operational characteristics of the user's own devices, but this might cause interference with the devices of others, and also might be in violation of applicable governmental regulations which limit the frequency range and transmission power of such devices. It should be noted that the maximum power which can or should be applied to such transmission devices can vary according to several factors. For example, current regulations allow that a greater amount of power be applied when using a directional antenna, as compared to an omni directional antenna.

It would be desirable to have a method or apparatus for easily adapting a wireless data communications apparatus to maximize its operational characteristics while still complying with legal standards. However, to the inventor's knowledge all prior art methods for adapting the power, and/or other transmission characteristics of a wireless data communications device have required operator intervention. This is undesirable because it requires that untrained personnel might have to make decisions and perform operations to make the necessary adjustments. Further, allowing the operator to make adjustments to the transmission characteristics allows for the possibility that users might intentionally optimize the transmission characteristics of their own devices to the detriment of others whose devices might incur interference, and also possibly in contravention of the applicable law.

SUMMARY

An example of an embodiment of the invention is a keyed antenna adaptor apparatus which has a keyed socket for accepting a keyed plug. The keyed plug is an electrical coaxial plug for plugging an external antenna into the keyed socket. The particular keyed plug is keyed so as to indicate that the antenna connected thereto is a particular type of antenna. The keyed socket is keyed such that if that particular type of antenna is not intended for use with the associated equipment, then the keyed plug will not fit therein. In some embodiments, the keyed plug has at least one microswitch which is depressed by a key on the keyed plug. Depression of the microswitch indicates that a particular type of antenna is connected. Depression of one or more of the microswitches will indicate which of several appropriate types of antennas is connected. According to the type of antenna connected, transmission parameters (such as power) are adapted to be the parameters appropriate for that antenna. In various embodiments of the invention, a wireless adaptor is signaled from the keyed socket to indicate which type of antenna is connected. In another example of an embodiment of the invention, data is transferred from the keyed socket to a processor which, in turn, signals a wireless adaptor to adjust output parameters according to the type of antenna attached. In some embodiments of the invention the keyed socket will also signal a switch to switch the signal between an internal antenna and an external antenna.

Accordingly, it is an object of the present invention to provide an apparatus and method for adapting an antenna to a data transmission device.

It is another object of the present invention to provide an apparatus and method for insuring that data transmission parameters are within prescribed regulatory limitations.

It is yet another object of the present invention to provide a quick and easy means and method for changing transmission parameters according to the type of antenna connected.

It is still another object of the present invention to provide a method and apparatus for allowing flexibility in transmission parameters and variables, while preventing unauthorized transmission parameters.

These and other objects and advantages of the present invention will become clear to those skilled in the art in view of the description of modes of carrying out the invention, and the industrial applicability thereof, as described herein and as illustrated in the several figures of the drawing. The objects and advantages listed or discussed herein are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and/or advantages. Accordingly, the listed objects and advantages are not essential elements of the present invention, and should not be construed as limitations.

DETAILED DESCRIPTION OF THE INVENTION

Figure 1:
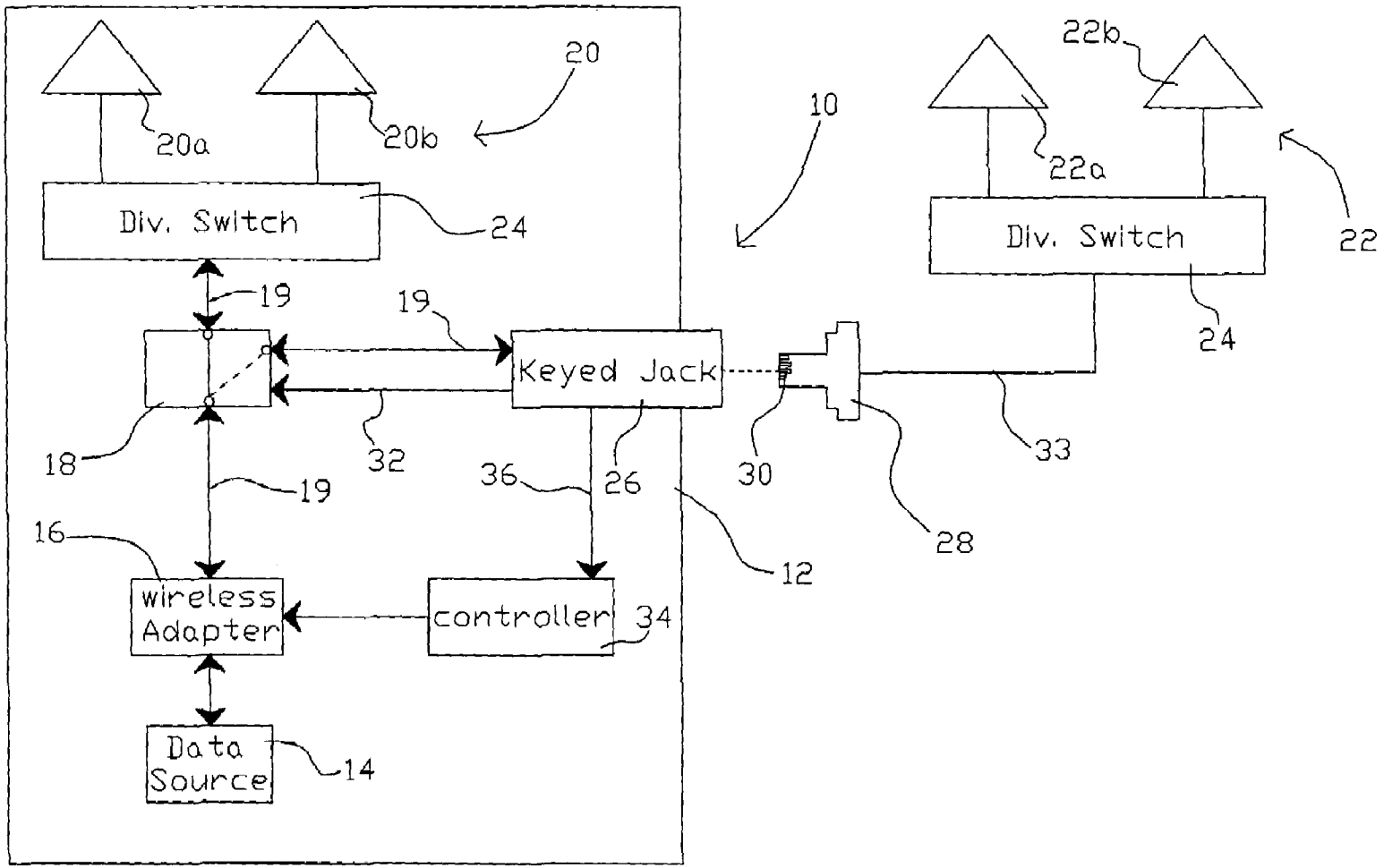
FIG. 1 is a block diagrammatic view of an example of a keyed antenna apparatus according to the present invention.

This invention is described in the following description with reference to the Figures, in which like numbers represent the same or similar elements. While this invention is described in terms of modes for achieving this invention's objectives, it will be appreciated by those skilled in the art that variations may be accomplished in view of these teachings without deviating from the spirit or scope of the present invention. The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A known mode for carrying out the invention is a keyed antenna apparatus. The inventive keyed antenna apparatus is depicted in a block diagram in the view of FIG. 1 and is designated therein by the general reference character 10. The keyed antenna apparatus 10 is shown in relation to a wireless access point 12. The wireless access point 12 can be a computer, a local area network ("LAN") router or hub, a wireless access port for a printer, or essentially any device wherein data is to be transmitted to and/or from a network by wireless means. The wireless access point 12 has a data source 14. One skilled in the art will recognize from the above description of the wireless access point 12 that, depending upon the exact nature of the wireless access point 12, the data source 14 can be a computer itself where the wireless access point 12 is a computer. Alternatively, the data source 14 can be a connection to a LAN, where the wireless access point 12 is a router. In the example of FIG. 1, the data source 14 is intended to represent essentially any device or connection which will be providing data to and accepting data from a wireless adapter 16. Further, it should be recognized that the data source can exist within the confines of the wireless access point 12, as illustrated in the view of FIG. 1, or can exist outside the wireless access point 12 and be connected thereto by a data cable such as a LAN connecting cable. The wireless adapter 16 is a device, the general type of which is known in the industry, for converting data from the data source 14 into a radio frequency signal, and further for converting received radio frequency signals into data to be provided to the data source 14.

In the example of the invention shown in FIG. 1, the wireless access point 12 has an antenna switch 18 for switching a radio frequency signal path 19 between a first antenna group 20 and a second antenna group 22. In the example of FIG. 1, the first antenna group 20 is an internal antenna group and the second antenna group 22 is an external antenna group.

According to this particular embodiment of the invention, the first antenna group 20 has a first antenna 20*a* and a second antenna 20*b*. Similarly, the second antenna group 22 has a first antenna 22*a* and a second antenna 20*b*. Each of the antenna groups 20 and 22 has a diversity switch 24 for switching between the respective antennas 20*a* or 20*b*, and 22*a* or 22*b*. The example of the diversity switches 24 is shown in the example of FIG. 1 to show how this feature can be integrated with the present invention. The diversity switches 24 are known devices which select one of the pairs of antennas 20*a*, or 20*b* and/or 22*a* or 22*b*, if one of the pair suffers destructive interference.

It is known in the art to provide the alternative between an internal and an external antenna. However, according to the present invention, a keyed jack 26 is provided which will selectively accept a keyed plug 28 only if a plurality of key protrusions 30 on the keyed plug 28 will mate with the keyed jack 26. Therefore, if the second antenna group 22 is terminated with the keyed plug 28, the second antenna group 22 cannot be plugged into the wireless access point 12 unless it has been predetermined that the second antenna group 22 is appropriate for use with the wireless access point 12, and the keyed plug 28 is specifically adapted to mate with the keyed jack 26. According to this embodiment of the present invention, an antenna switch data connection 32 provides a signal from the keyed jack 26 to the antenna switch 18 to inform the antenna switch 18 that the external second antenna group 22 is plugged into the keyed jack 26. This signal causes the antenna switch 18 to switch signal path 19 from the first antenna group 20 to the second antenna group 22. One skilled in the art will recognize that the second antenna group 22 is connected to the keyed plug 28 via a coaxial cable 33.

In the particular embodiment of the keyed antenna apparatus 10 depicted in the view of FIG. 1, the wireless adapter 16 has the capability of providing a radio frequency output (to the antenna switch 18 in this example) at one of two or more preselected power levels, depending upon whether the first antenna group 20 or the second antenna group 22 is presently in use and/or upon the exact nature of the second antenna group 22. If the wireless adapter 16 is provided with inputs for selecting the appropriate power output level, then a select signal could be provided directly to such inputs, and such an example is contemplated by the inventor. However, if the wireless adapter 16 accepts only data inputs, an analog to digital encoder (controller) 34 can be provided to convert a simple analog signal (such as a switch closing to ground, or the like, as will be discussed in greater detail hereinafter) from the keyed jack 26 to a data signal for the wireless adapter 16.

Figure 2:
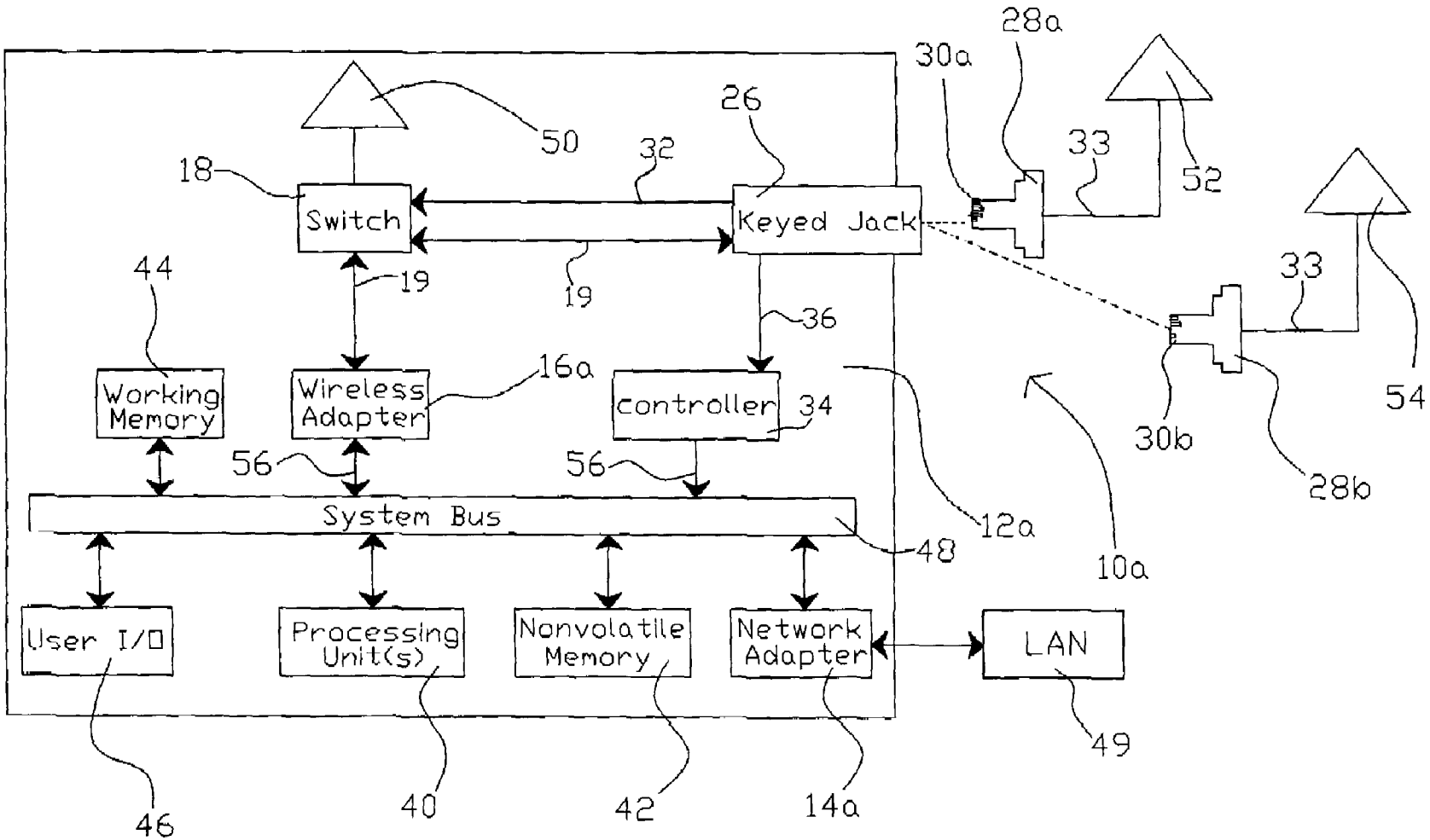
FIG. 2 is a block diagrammatic view of a second example of a keyed antenna apparatus according to the present invention.

FIG. 2 is a block diagram of another possible embodiment of the inventive keyed antenna apparatus 10*a*. In the example of FIG. 2, an alternate wireless access point 12*a* is "intelligent", in that it is equipped with a processing unit 40. A nonvolatile memory 42 and a working memory 44 are provided for use by the processing unit 40. In this example, a user input/output user I/O 46 is provided for controlling, programming, and/or monitoring the wireless access point 12*a*. One skilled in the art will recognize that the user I/O 46, if provided, can be quite complex, or can be as simple as indicator lights and/or a universal serial bus ("USB") connector, or the like. In this example, all of the components shown in the view of FIG. 2 connected thereto connect through a single system bus 48. A data source 14*a* which, in the present example is a conventional network adapter, is also connected to the system bus 48. The data source 14*a* provides data input and output between the wireless access point 12*a* and a local area network ("LAN") 49.

In the example of FIG. 2, the antenna switch 18 switches the signal path 19 between an internal antenna 50 and the keyed jack 26. In this example there are two alternative antennas (a first external antenna 52 and a second external antenna 54 which might, optionally, be connected to the wireless access point 12*a* through the keyed jack 26. The first external antenna 52 has a first keyed plug 28*a* having a first key protrusions 30*a* pattern, while the second external antenna 54 is optionally connected via a second keyed plug 28*b* having a second key protrusions 30*b* pattern. In the present example the first external antenna 52 and the second external antenna 54 are of two different distinct types, such that it is desirable to know which of the two is connected to the keyed jack 26*a*. According to the present invention, the keyed jack 26 will sense which (if either) of the key protrusion patterns 30*a* or 30*b* is inserted therein, thereby sending a signal to the controller 34 which will, in turn inform the processing unit 40 via the system bus 48. The processing unit 40 will then signal the wireless adapter 16*a* to set the output parameter(s) such as power, according to predetermined values which can be stored either in the nonvolatile memory 42 or the working memory 44. In this example, all communication between the system bus 48 and the wireless adapter 16*a* is via a data connection 56, such that both the data to be transmitted and instructions to the wireless adapter 16*a* are provided on the same data path. However, it is within the scope of the invention that separate data channels could be provided for instructions and for the transmission of the subject data.

It can be appreciated that the embodiment of the invention shown and described in relation to FIG. 2 is quite versatile, in that programming can be changed such that parameter values can be varied by a change in the software. For instance, it might be that different power values are allowed in different countries for the same first external antenna 52. In such an example, software variables could be altered according to which country the wireless access point 12*a* is to be used. Then when the keyed jack 26 senses that the first external antenna 52 is connected to the wireless access point 12*a*, the appropriate power level for the instant country could be set. That is, the software either stored in the nonvolatile memory 42 or loaded into the working memory 44 can set the maximum legal power (and/or other signal parameters) allowable, depending upon which of the antennas 52 or 54 is connected, and that software can be altered when and if required by the circumstances.

Figure 3:
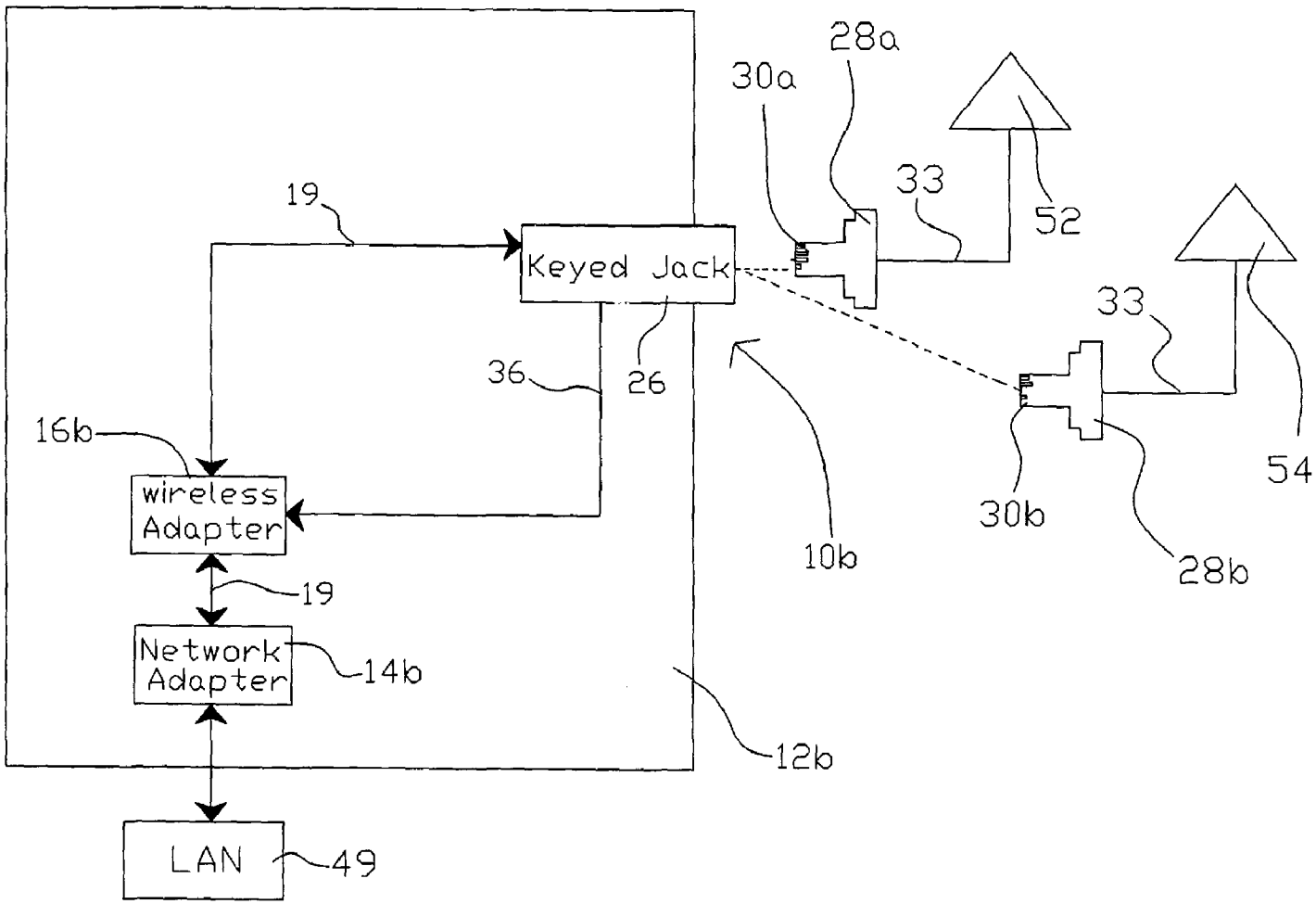
FIG. 3 is a block diagrammatic view of yet another example of a keyed antenna apparatus according to the present invention.

FIG. 3 is yet another example of an embodiment of the keyed antenna apparatus 10*b* wherein a wireless access point 12*b* is provided which will vary output parameters according to which of the two antennas, the first external antenna 52 or the second external antenna 54, is connected thereto. In the example of FIG. 3, a wireless adapter 16*b* is adapted to receive an input directly from the keyed jack 26, and further to adjust its output parameters accordingly. Data source 14*b* is a network interface that receives and provides data to the LAN 49. The example of FIG. 3 illustrates the point that an internal antenna is not a necessary part of the invention, and the inventive apparatus and method can be used only to select output parameters according to which of several external antennas might be connected.

Figure 4:
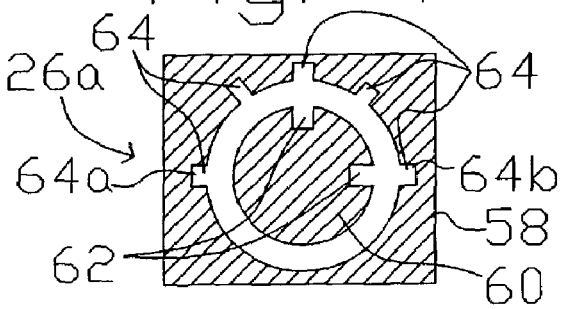
FIG. 4 is a cross sectional end view of an example of a keyed jack apparatus according to the present invention.

FIG. 4 is a diagrammatic cross sectional view of a particular example of an alternate embodiment of the keyed jack 26*a*. In the view of FIG. 4 it can be seen that the keyed jack 26*a* has a plurality (two in the example shown) of inner notches 62 and a plurality (five in the example shown) of outer notches 64. The shape, size, placement, quantity and/or other characteristics of the notches 62 and 64 are subject to a great many variations, such that only a particular keyed plug 28 (FIG. 1) will fit therein. It should be noted that it is not necessary to include both the inner notches 62 and the outer notches 64 in the design. Rather, one or the other would suffice for the purpose. Also, many other variations in the shape and design of the keyed jack 26*a* are certainly possible, which will be discussed in more detail hereinafter. As can be seen in the view of FIG. 4, the keyed jack 26*a* has an outer jack conductor 58 and an inner jack conductor 60, as is appropriate for terminating the coaxial cable 33 (FIGS. 1, 2 and 3), although one skilled in the art will recognize that other conductor arrangements are possible to terminate the coaxial cable 33.

Figure 5:
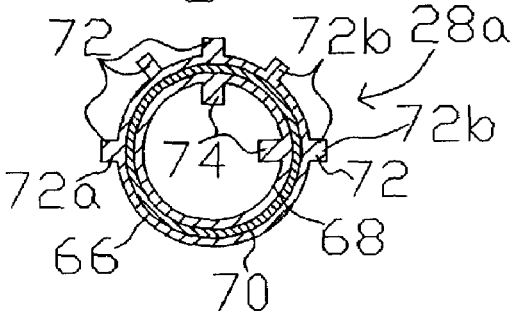
FIG. 5 is a cross sectional end view of an example of a keyed plug apparatus according to the present invention.

FIG. 5 is a diagrammatic cross sectional view of a particular example of an alternate embodiment of the keyed plug 28*a*. As is customary for coaxial plug connectors, the keyed plug 28*a* has an outer plug conductor 66 (for coming into contact with the outer jack conductor 58 of the keyed jack 26*a* of FIG. 4) and an inner plug conductor 68 (for coming into contact with the inner jack conductor 60 of the keyed jack 26*a* of FIG. 4). The outer plug conductor 66 and the inner plug conductor 68 are separated by an insulator 70. The example of the keyed plug 28*a* of FIG. 5 has a plurality (two in the example of FIG. 5) of inner plug key projections 74 which will fit within the inner notches 62 of the keyed jack 26*a* (FIG. 4). The example of the keyed plug 28*a* of FIG. 5 further has a plurality (five in the example of FIG. 5) of outer plug key projections 76 which will fit within the outer notches 64 of the keyed jack 26*a* (FIG. 4). As can be appreciated, then, from a comparison of the examples of FIGS. 4 and 5, the keyed plug 28*a* will fit into the keyed jack 26*a*, but so also would a "plain" plug with neither the outer plug key projections 72 nor the inner plug key projections 74 thereon. Whether or not this is a problem depends upon the application, and will be discussed hereinafter in more detail in relation to the industrial applicability of the invention.

Figure 6:
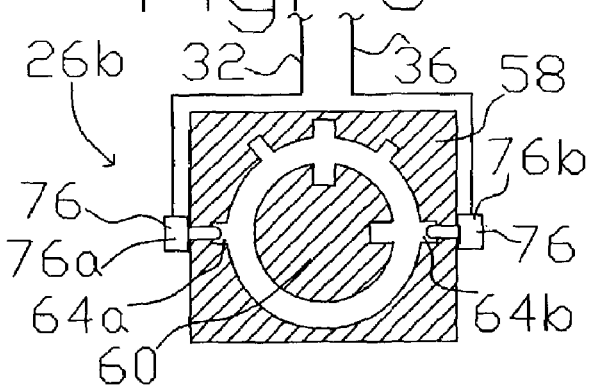
FIG. 6 is an example of yet another possible embodiment of the inventive keyed jack apparatus.

FIG. 6 is a diagrammatic cross sectional view, similar to the view of FIG. 4, depicting yet another example of an embodiment of the inventive keyed jack 26*b*. According to the example of the keyed jack 26*b* depicted in FIG. 6, a plurality (two in the present example) of microswitches 76 are provided. A first microswitch 76*a*, when depressed, sends a "signal" on the antenna switch data connection 32 to cause the antenna switch 18 (FIGS. 1 and 2) to switch the signal path 19 to the external antennas 52, 54 (FIG. 2) or antenna group 22 (FIG. 1). In the embodiment of the invention shown and described in relation to FIG. 6, the "signal" is the shorting of the antenna switch data connection 32 to the outer jack conductor 58. One skilled in the art will recognize that there are many other alternatives, such as shorting the antenna switch data connection 32 to chassis ground (if that is different from signal ground), putting a voltage onto the antenna switch data connection 32 when the microswitch 76*a* is closed, or the like, which alternatives could equally be used to cause the antenna switch 18 to activate. Therefore, according to the embodiment of the inventive keyed jack 26*b* depicted in FIG. 6, unless the inserted plug (such as the keyed plug 28*a* of FIG. 5) has the particular outer plug key projection 72*a* thereon, the antenna switch 18 will not switch the signal path 19 as previously described herein.

Also in the view of FIG. 6 can be seen a second microswitch 76*b*. The second microswitch 76*b* is connected to the antenna type data line 36. As previously discussed herein, the antenna type data line 36 is used to inform apparatus within the wireless access point 12, 12*a*, 12*b* which of several possible external antennas 52, 54, or the like, is connected thereto, so that transmission parameters can be modified accordingly. The same signaling alternatives (grounding to the outer jack conductor 58, grounding to chassis ground, applying a voltage, and others not specifically discussed) exist for the second microswitch 76*b* as were previously discussed herein in relation to the first microswitch 76*a*. Given the above descriptions, it should be noted that signal (or absence of signal) on the antenna switch data connection 32 could be referred to as an "antenna present" signal, while signal (or absence of signal) on the antenna type data line 36 could be referred to as an "antenna type" signal.

Figure 7:
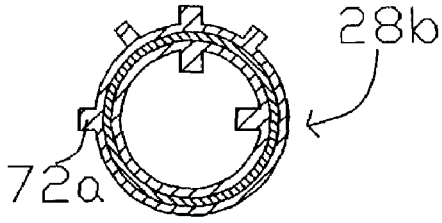
FIG. 7 is an example of yet another possible embodiment of the inventive keyed plug apparatus.

FIG. 7 is a diagrammatic cross sectional view, similar to the view of FIG. 5, depicting yet another example of an embodiment of the inventive keyed plug 28*b*. In the example of the keyed plug 28*b*, the outer plug key projection 72*b* is missing (as compared to the example of FIG. 5). Therefore, when the keyed plug 28*b* is inserted into the keyed jack 26*b* of FIG. 5, the antenna switch data connection 32 will signal the antenna switch 18 to switch the signal path 19 through the keyed jack 26. However, no "signal" will be applied to the antenna type data line 36 because the second microswitch 76*b* will not be depressed. One skilled in the art will understand that the examples of FIGS. 5, 6 and 7 provide the alternative of no external antenna (in which case the first microswitch 76*a* will not be depressed), or either one of two external antennas such as antennas 50 or 52, wherein one of the external antennas is terminated with a keyed plug 28*a* such as the example of FIG. 5 and the other is terminated with a keyed plug 28*b* such as the example of FIG. 7. One skilled in the art will also recognize that additional microswitches 76 could readily be used to provide even more selections. For example, if two of the microswitches were used just to inform the wireless access point 12, 12, 12*b* as to which of several external antennas were connected, as many as four different external antennas might be automatically adapted. Which of the four external antennas could be identified by determining whether both, neither, the first only, or the second only of the two microswitches 76 is depressed by an appropriately modified keyed plug 28.

It should be noted that it is in the very nature of mechanically keyed devices that the possible variations in the shape, keying arrangement, and overall design of the keyed apparatus are nearly infinite. Literally thousands of examples of different possible shapes of the keyed plug 28, the key protrusions 30, and the corresponding keyed jack 26 could be provided, without beginning to exhaust the list of possible variations. Just one of the examples of such variations would be to array the key projections on the keyed jack 26 linearly along its length, and to position the microswitches 76 linearly such that certain of the key projections would depress certain of the microswitches 76. Another obvious variation would be to vary the linear depths of the inner notches 62 and/or the outer notches 64 in the keyed jack 26 such that the keyed plug 28 would "bottom out" in some of the notches before it could be fully inserted into the keyed jack 26.

Figure 8:
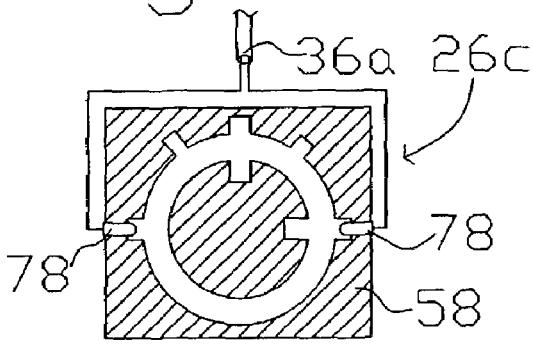
FIG. 8 is an example of still another possible embodiment of the inventive keyed jack apparatus.

Just as there are many possible variations in the type, shape, and design of the mechanical keying arrangements. There are also a great many possible variations in the means used for producing an electrical signal from the keyed jack 26 to inform the wireless access point 12, 12*a*, 12*b* of the type of antenna 52, 54, or the like, which is connected thereto. One skilled in the art will recognize that other types of sensors magnetic sensors, or the like could be employed in place of the microswitches 76 discussed in relation to the previous examples. Another of the many possible variations is illustrated in the example of FIG. 8. In the example of FIG. 8 two electrical contacts 78 are shown in a third alternate embodiment of the keyed jack 26*c*, which electrical contacts 78 would make contact with the outer plug conductor 66 of the keyed plug 28*a* of FIG. 5, if that keyed plug 28*a* were inserted into the keyed jack 26*c*. In such a situation an electrical path would be created between the two electrical contacts 78 which condition would be communicated to the wireless access point 12, 12*a*, 12*b* via the (two conductor in this example) antenna type data line 36*a*. Other possible variations of this basic scheme would be to place both of the electrical contacts 78 in the same outer notches 64 (FIG. 4) such that a single outer plug key projection 72 would short together the two electrical contacts 78. Yet another possible such variation would be to cause the electrical contact 78 to short to the outer jack conductor 58, which condition could be used to signal the wireless access point 12, 12*a*, 12*b*. In this last example, fewer electrical conductors in the antenna type data line 36*a* might be required. Yet another possible variation of this basic scheme would be to provide a separate electrical path (distinct from either the outer jack conductor 58 or the inner jack conductor 60, which conductors will also carry the radio frequency signal) on the keyed jack 26, or the keyed plug 28, (FIG. 1) which separate electrical path would short together two of the electrical contacts 78 when the keyed plug 28 is inserted into the keyed jack 26.

Various modifications may be made to the invention without altering its value or scope. For example, the sizes, shapes and quantities of components shown and described in relation to the examples discussed herein could each or all be varied according the needs or convenience of a particular application.

Another possible variation of the present invention would be to use the signal from the antenna type data line 36 to selectively switch the signal path 19 through a signal modifying means such as an attenuator. Although the invention has been described herein as providing instructions, either directly or indirectly, to a wireless adapter/transmitter, which will modify a signal characteristic such as power, one skilled in the art will recognize that this is by no means the only way to modify output signal characteristics. The above example of selectively varying the signal path 19 through alternative modification means is just one such example.

Although power is a primary signal characteristic which the inventor anticipates will be modified according to the present invention, this is by no means the only possible characteristic which might be so modified. For example, the frequency or signal protocol of the output signal might be modified. Another likely parameter to modify would be the output impedance. One skilled in the art will recognize that matching output impedance to the particular antenna in use can be important in the avoidance of off frequency interference.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive keyed antenna apparatus 10, 10*a*, 10*b* is intended to be widely used for adapting wireless data communications devices to a variety of external antennas, thereby optimizing operational characteristics while complying with applicable laws.

A particular example is found in the fact that many schools today use trailers on a parking lot as a temporary expansion classroom. A school teacher may wish to install a directional, high gain antenna on a base station, pointed at the remote classroom thus providing Internet service there. The use of the inventive plug jack connector system will make it easy and simple to do this, while retaining the legality of the product and application. As an example only, it should be noted that an omnidirectional antennal might transmit reliably over a radius of approximately 150 feet, while staying within applicable FCC requirements, while a directional antenna might transmit as far as from 200 to 400 feet.

Regarding the previously introduced question concerning whether or not it is important that a keyed jack 26 could be contrived which would fit within the keyed plug 28 even though it is connected to an antenna which is not of the type which should be connected, it should be remembered that one of the intended purposes of the present invention is to assist well intentioned users in adapting the wireless access point 12, 12*a*, 12*b*, and the like, to the various antennas 52, 54, and the like. Another purpose is to put at least some obstacle in the way of those who would intentionally connect an antenna which might not be appropriate for the output power level of the access point 12, 12*a*, 12. If all of the antennas which are sold to be used with the various embodiments of the invention have the appropriate external key projections, then these objectives can be easily achieved according to the present invention. Of course, it would be easy to modify the invention to further make it difficult to insert the "wrong" plug in the jacks. One example would be to put a notch in the plug and a corresponding projection on the internal surface of the jack. However, no such measure within practical limitations could prevent a determined lawbreaker from making illicit modifications to the apparatus. One example would be that the user could go to the extreme of cutting the coaxial cable 33 and grafting the "wrong" keyed jack 26 thereto. However, all of this does not detract from the usefulness of the present invention for its intended purpose. According to the present invention, the appropriate antenna can be readily fitted without the necessity for the user to determine the correspondingly appropriate output characteristic parameters.

According to at least some embodiments of the invention, the inventive apparatus can be readily adapted to account for variables such as the differing laws of different countries, changes in the applicable laws, the introduction of new types of antennas, and the like.

It is anticipated that the present invention can be accomplished using a conventional 802.11x wireless fidelity ("WiFi") Ethernet adapter as the wireless adapter 16. However, as previously discussed herein, it might also be advantageous to provide specialized wireless adapters 16 which can more readily respond to signals from the keyed antenna apparatus 10, 10*a*, 10*b* to modify output parameters.

As described herein, the keyed antenna apparatus 10, 10*a*, 10*b* are efficient and economical in operation. Since the keyed antenna apparatus 10, 10*a*, 10*b* of the present invention may be readily produced and integrated with existing computer network systems and wireless access point devices, and since the advantages as described herein are provided, it is expected that it will be readily accepted in the industry. For these and other reasons, it is expected that the utility and industrial applicability of the invention will be both significant in scope and long-lasting in duration.

CORRESPONDENCE CHART

10 KEYED ANTENNA APPARATUS
12 WIRELESS ACCESS POINT
12A WIRELESS ACCESS POINT
12B WIRELESS ACCESS POINT
14 DATA SOURCE
14A DATA SOURCE
14B DATA SOURCE
16 WIRELESS ADAPTER
16A WIRELESS ADAPTER
16B WIRELESS ADAPTER
18 ANTENNA SWITCH
19 RADIO FREQUENCY SIGNAL PATH
20 FIRST ANTENNA GROUP
22 SECOND ANTENNA GROUP
24 DIVERSITY SWITCH
26 KEYED JACK
26A KEYED JACK
26B KEYED JACK
26C KEYED JACK
28 KEYED PLUG
28A KEYED PLUG
28B KEYED PLUG
30 KEY PROTRUSIONS
32 ANTENNA SWITCH DATA CONNECTION
34 CONTROLLER
36 ANTENNA TYPE DATA LINE
40 PROCESSING UNIT
42 NONVOLATILE MEMORY
44 WORKING MEMORY
46 USER I/O
48 SYSTEM BUS
50 INTERNAL ANTENNA
52 FIRST EXTERNAL ANTENNA
54 SECOND EXTERNAL ANTENNA
56 DATA CONNECTION
58 OUTER JACK CONDUCTOR
60 INNER JACK CONDUCTOR
62 INNER JACK NOTCHES
64 OUTER JACK NOTCHES
64A FIRST OUTER JACK NOTCH
64B SECOND OUTER JACK NOTCH
66 OUTER PLUG CONDUCTOR
68 INNER PLUG CONDUCTOR

70 INSULATOR
72 OUTER PLUG KEY PROJECTIONS
72A FIRST OUTER PLUG KEY PROJECTION
72B SECOND OUTER PLUG KEY PROJECTION
74 INNER PLUG KEY PROJECTIONS
76 MICROSWITCH
76A FIRST MICROSWITCH
76B SECOND MICROSWITCH
78 ELECTRICAL CONTACT

I claim:

1. An antenna connection apparatus comprising:
a jack adapted to receive a keyed antenna plug; and
a switch mounted with respect to the jack so as to engage the keyed antenna plug; and
wherein the switch is operative to generate a signal to indicate that the keyed antenna plug is inserted in the jack when the keyed antenna plug is completely inserted into the jack.

2. The antenna connection apparatus of claim 1, wherein:
the keyed antenna plug is electrically connected to an antenna; and
a key feature on the keyed antenna plug is associated with the antenna.

3. The antenna connection apparatus of claim 2, wherein;
the key feature is a protrusion from the surface of the keyed antenna plug.

4. The antenna connection apparatus of claim 1, wherein:
the switch is a microswitch.

5. The antenna connection apparatus of claim 1, wherein:
when the switch is operated, a signal path is diverted from an internal antenna to the jack.

6. The antenna connection apparatus of claim 1, wherein:
when the switch is operated, a characteristic of an output signal provided to the jack is set.

7. The antenna connection apparatus of claim 6, wherein:
the operational characteristic is signal power.

8. The antenna connection apparatus of claim 1, wherein:
said jack is disposed in an electronic device and facilitates the connection of an external antenna to said electronic device via said keyed antenna plug.

9. An antenna connecting apparatus for connecting an antenna to a wireless data station, comprising:
a keyed antenna jack affixed to the wireless data station;
a plurality of keyed antenna plugs for inserting into the keyed jack, each of the plurality of keyed plugs having a different key feature indicative of a different antenna type; and
an electrical circuit completion apparatus for completing an electrical circuit when one of the keyed plugs is completely inserted into the keyed jack.

10. The antenna connecting apparatus of claim 9, wherein:
the electrical circuit completion apparatus is a microswitch.

11. The antenna connecting apparatus of claim 9, wherein:
the electrical circuit completion apparatus is an electrical contact.

12. The antenna connecting apparatus of claim 9, wherein:
the electrical circuit completion apparatus causes a signal parameter to be changed in the wireless data station.

13. The antenna connecting apparatus of claim 9, wherein:
the electrical circuit completion apparatus causes a radio signal generating device to vary its output power level according to whether or not the circuit is completed.

14. The antenna connecting apparatus of claim 9, wherein:
each of the keyed plugs is associated with a particular type of antenna.

15. The antenna connecting apparatus of claim 9, wherein:
the electrical circuit completion apparatus causes a radio signal path to change.

16. The antenna connecting apparatus of claim 9, wherein:
each of the plurality of keyed plugs is electrically connected to an associated antenna.

17. The antenna connecting apparatus of claim 9, wherein:
the key feature is a protrusion on the keyed plug.

18. The antenna connecting apparatus of claim 9, wherein:
the key feature is an irregular portion on a surface of the keyed plug.

19. A wireless data transfer antenna apparatus, comprising:
an antenna;
a keyed antenna plug; and
an electrical cable for conducting signals between the antenna and the keyed antenna plug,
wherein:
the keyed antenna plug has a key feature which identifies the type of antenna when the antenna plug is completely inserted in an antenna jack.

20. The wireless data transfer antenna apparatus of claim 19, wherein:
the keyed antenna plug is adapted for insertion into a keyed antenna jack, the keyed antenna jack being equipped to send an antenna type signal when the key feature is detected.

21. The wireless data transfer antenna apparatus of claim 19, wherein:
the keyed antenna plug is adapted for insertion into a keyed antenna jack, the keyed antenna jack being equipped to send an antenna present signal when the key feature is detected.

22. The wireless data transfer antenna apparatus of claim 19, wherein:
the key feature is an irregular feature on a surface of the keyed antenna plug.

23. The wireless data transfer antenna apparatus of claim 19, wherein:
the key feature is a protrusion on the keyed antenna plug.

24. A jack for accepting a keyed antenna plug having a particular key feature on the keyed antenna plug, the jack comprising:
an aperture wherein the keyed antenna plug is inserted; and
a key detection feature for detecting the presence of the particular key feature indicative of a particular antenna tipe on the keyed antenna plug when the keyed antenna plug is completely inserted in the jack.

25. The jack of claim 24, wherein:
the key detection feature includes a notch for accepting a key protrusion on the keyed antenna plug.

26. The jack of claim 24, wherein:
the key detection feature includes an electrical circuit completion apparatus for providing an electrical signal when the particular key feature is detected.

27. The jack of claim 24, wherein:
the key detection feature includes a microswitch which is engaged by the key feature.

* * * * *